US006638576B2

(12) United States Patent
Clarke et al.

(10) Patent No.: US 6,638,576 B2
(45) Date of Patent: Oct. 28, 2003

(54) APPARATUS AND METHOD OF COATING A WEB

(75) Inventors: Andrew Clarke, Hertfordshire (GB); Christopher L. Bower, Oxon (GB); Kim E. Goppert, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/128,086

(22) Filed: Apr. 23, 2002

(65) Prior Publication Data

US 2002/0192382 A1 Dec. 19, 2002

(30) Foreign Application Priority Data

Apr. 25, 2001 (GB) ..... 0110111

(51) Int. Cl.[7] ..... B05D 1/26; B05D 3/14

(52) U.S. Cl. ..... 427/470; 427/458; 427/402; 427/420

(58) Field of Search ..... 427/458, 470, 427/402, 420; 118/410, 411, 621

(56) References Cited

U.S. PATENT DOCUMENTS

| | | | | |
|---|---|---|---|---|
| 2,681,294 A | | 6/1954 | Beguin | |
| 2,761,791 A | | 9/1956 | Russell | |
| 3,335,026 A | | 8/1967 | DeGeest et al. | |
| 4,113,903 A | | 9/1978 | Choinski | |
| 4,835,004 A | | 5/1989 | Kawanishi | |
| 5,340,616 A | * | 8/1994 | Amano et al. | 427/458 |
| 5,393,571 A | | 2/1995 | Suga et al. | |
| 6,103,313 A | * | 8/2000 | Clarke et al. | 427/420 |

FOREIGN PATENT DOCUMENTS

| | | |
|---|---|---|
| EP | 0 390 774 B1 | 7/1992 |
| EP | 0 716 890 B1 | 4/2000 |
| EP | 0 996 033 A1 | 4/2000 |
| EP | 0 996 034 A1 | 4/2000 |
| EP | 1 013 586 A3 | 5/2001 |
| WO | WO 89/05477 | 6/1989 |

* cited by examiner

*Primary Examiner*—Katherine A. Bareford
(74) *Attorney, Agent, or Firm*—Milton S. Sales

(57) ABSTRACT

An apparatus and method of bead coating a web using a coating die. The method comprises forming one or more layers of coating material using the coating die and allowing the one or more layers to impinge on the web as the web and die move relative to each other. The web surface has an average peak to peak roughness as defined by DIN 4768, ISO4287 or BS1134 between 2 $\mu$m and 20 $\mu$m. The layer of coating material forming a wetting layer adjacent to the web has a viscosity of between 35 mPas and 200 mPas measured at a shear rate of substantially 10,000 $s^{-1}$. An electrostatic field is provided at the point at which the layers impinge on the web to stabilize the layers of coating material. The method enables the web being coated to be conveyed at a speed greater than 400 cm/s relative to the coating die whilst avoiding the problem of air entrainment.

15 Claims, 3 Drawing Sheets

APPARATUS AND METHOD OF COATING A WEB

FIELD OF THE INVENTION

The present invention relates to an apparatus and method by which viscous liquid compositions may be coated on to a web such as a continuously moving web of material, as in the manufacture of photographic material such as films, photographic papers, magnetic recording tapes, adhesive tapes, etc.

BACKGROUND OF THE INVENTION

Bead coating is a method of coating used extensively in the manufacture of photographic material and products. In this method a liquid bridge known as the bead is formed between a coating die and a web to be coated. The basic technology is well established and is discussed in, for example, U.S. Pat. Nos. 2,681,294 and 2,761,791. The latter relates specifically to multi-layer coating in which two or more layers are simultaneously applied to a continuously moving web of material in the manufacture of photographic materials. Typically, multi-layer flow of a coating liquid on an inclined plane of the die is used. The coating liquid flows towards the web to be coated and contacts the web at an impingement point. There are a number of limitations to the maximum speed of the bead coating method and these are discussed in, for example, the book entitled "Liquid Film Coating", ed. S. F. Kistler and P. M. Schweizer, Pub. Chapman Hall. A fundamental limit to the coating speed in most coating operations is the incorporation of macroscopic bubbles of air between the web and the coating solution, known as air entrainment.

Various methods have been proposed to postpone air entrainment to higher speeds of coating i.e. to increase the threshold coating speed above which air entrainment occurs. In many of these methods, advantage is taken of the understanding that lower viscosities for the layer that wets the web (the wetting layer) enables the threshold speed to be increased. However, having a low viscosity layer adjacent to the inclined plane of the coating die can endanger the stability of the multi-layer flow. More importantly, the bead stability is reduced as the viscosity of the wetting layer is reduced. To address these problems a shear thinning lowermost layer may be used, as disclosed in U.S. Pat. No. 4,113,903, which issued in the name of E. J. Choinski on Sep. 12, 1978. In this patent, a system is provided in which the viscosity in the majority of the bead is high while the viscosity at very high shear near the wetting line is low. In this way the conflicting requirements of low viscosity for high-speed wetting and high viscosity for flow on the inclined plane of the coating die and in the bead can be satisfied simultaneously.

Another method to increase the threshold speed above which air entrainment occurs employs the use of an electrostatic field as disclosed in International Patent Application No. WO 89/05477 in the name of Eastman Kodak Company. In addition to increasing the threshold coating speed, an electrostatic field applied at the impingement point has a beneficial effect of stabilizing the bead in a similar way to that of a vacuum or reduced pressure region provided beneath the bead between the coating die and the web. It is well known that providing a charge on the web surfaces and grounding both the coating roller and the coating liquid may generate the electrostatic field. This is disclosed, for example, in International Patent Application No. WO 89/05477 or U.S. Pat. No. 4,835,004 in the name of Kawanishi. It is also possible to bias the coating roller whilst maintaining the coating liquid at ground potential, as disclosed in U.S. Pat. No. 3,335,026. Alternatively a combination of both of these methods may be used.

As the coating speed is increased, higher voltages are required to achieve the beneficial effects discussed above. However, as the voltage is increased, voltage induced perturbations are introduced to the bead, which can cause corresponding defects in the coating formed on the web. The severity of these voltage-induced defects increases as the applied voltage is increased. Therefore, there is a maximum practical voltage above which the disadvantageous voltage-induced defects outweigh the benefits obtained to the stability of the bead.

The threshold speed above which air entrainment occurs is also dependent on the surface roughness of the web to be coated. For example, International Patent Application No. WO 89/05477 discloses a bead coating example in which the threshold coating speed above which air entrainment occurs is slower for a rough web such as Matte paper than it is for a smoother web such as glossy paper. This is the case at low viscosity, such as 4.6 mPas and 6.5 mPas, even in the presence of an applied electrostatic field.

Problem to be Solved by the Invention

Apparatus and method of coating a web is required that enables the threshold coating speed above which air entrainment occurs to be maximised. In particular a method of coating a rough web is required which enables the web to be coated without air entrainment at speeds comparable to those at which smooth webs can be coated. The apparatus and method is required for use in the manufacture of, amongst others, photographic material such as films and photographic paper, magnetic recording tapes, adhesive tapes, etc.

SUMMARY OF THE INVENTION

According to the present invention, there is provided a method and apparatus of bead coating a web using a coating die. One or more layers of coating material is formed using the coating die, allowing the one or more layers to impinge on the web as the web and die move relative to each other. The web surface has an average peak to peak roughness (Rz) as defined by DIN 4768, ISO4287 or BS1134 greater than or equal to 2 $\mu$m and less than or equal to 20 $\mu$m, wherein the layer of coating material forming a wetting layer adjacent to the web has a viscosity of between 35 mPas and 200 mPas measured at a shear rate of substantially 10,000 $s^{-1}$. An electrostatic field is provided at the point at which the one or more layers impinge on the web to stabilize the one or more layers of coating material.

Preferably, the support is a backing roller and the electrostatic field is provided by a voltage of between 250V and 2000V between the one or more layers and the backing roller. More preferably, the voltage is between 600V and 1500V. Preferably, the roughness Rz is greater than 4 $\mu$m and less than 10 $\mu$m.

Advantageous Effect of the Invention

The present invention provides an apparatus and method whereby rough surfaces can be coated at high speed. The invention enables the web being coated to be conveyed at a speed greater than 400 cm/s relative to the coating die whilst avoiding the problem of air entrainment. Conventionally, it is suggested that to achieve higher coating speeds without air entrainment it is necessary to use smooth surfaced webs and a low viscosity wetting layer. In contrast to this, the present invention relies on the use of a wetting layer having a relatively high viscosity, a web to be coated having an average peak to peak roughness (Rz) of between 2 and 20 μm and the provision of an electrostatic field to stabilise the one or more layers of coating material.

Since coating compositions of high viscosity are used, the invention therefore has the added advantage that the coating solutions on the slide of the coating die have improved stability. In addition, since the viscosity can be increased, the water content of the coating solutions can be reduced to better utilize the drying capacity of the manufacturing process. It can be seen that in the present invention, the use of high viscosity coating solutions does not compromise the maximum coating speed defined by air-entrainment.

BRIEF DESCRIPTION OF THE DRAWINGS

Examples of the present invention will now be described in detail with reference to the accompanying drawings, in which.

DETAILED DESCRIPTION OF THE INVENTION

Figure 1:
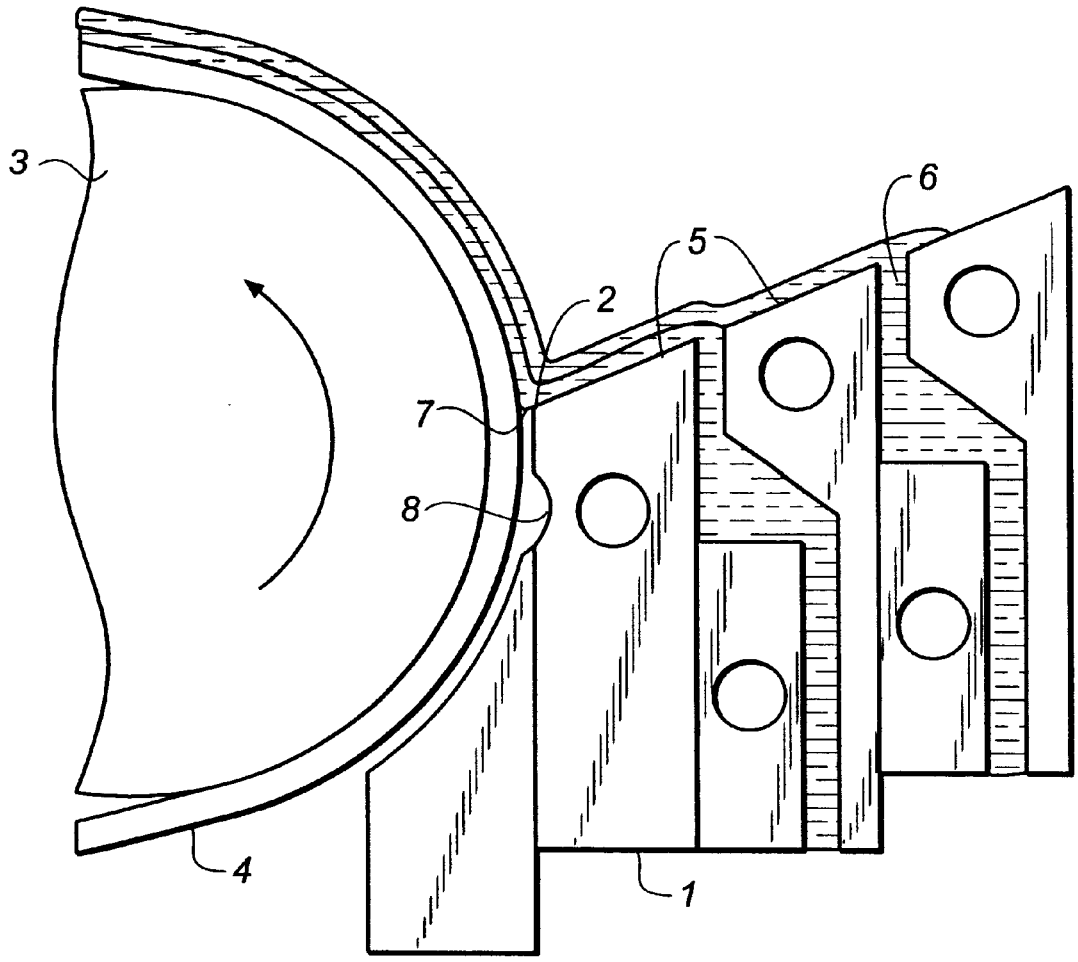
FIG. 1 is a schematic view of a conventional bead coating arrangement.

A typical arrangement of a multi-layer bead coating die together with a coating roller is shown in FIG. 1. A coater lip 2 is provided in the vicinity of a back-up roller 3, around which the web 4 is wound and conveyed with a clearance. A sliding plane 5 for the coating solutions is formed on the uphill slope of the coater. Slots 6 are provided to supply the coating solutions. The coating solutions form a bead 7 at the outlet of the coater lip. The bead may be stabilized by the use of a reduced pressure chamber 8. Multi-layer coating is achieved by supplying several slots in the die each with a coating composition. Single layer coating is achieved by supplying one or more slots with a single coating composition. An electrostatic field is introduced between the coating solution and the web either by biasing the coating roller or by providing the web with a charge and grounding the coating roller, or by a combination of these two methods.

The effect of the present invention is obtained when the following criteria are met simultaneously:

1. A rough web is used where the average peak—peak roughness Rz (as defined by DIN 4768, ISO4287 or BS 1134) is greater than about 2 μm and preferably less than 20 μm.
2. The viscosity of the coating composition forming the layer adjacent to the web, measured at a shear rate of 10,000 $s^{-1}$ is between about 35 mPas and 200 mPas, and can be between 50 mPas and 100 mPas.
3. An electrostatic field is generated at the impingement point between the coating liquid and the web. This may be achieved, for example, either by the use of a biased coating roller or by the use of charge on the web, or both, such that the voltage measured on the side of the web to be coated and at the coating point is between about 250V and 2000V.

This enables coating speeds greater than about 400 cm/s to be achieved without encountering the problem of air-entrainment.

The roughness of the web may be conveniently measured using a WYKO NT2000, WYKO Corporation, and the viscosity by using a Bohlin CS rheometer. Other methods and instruments also exist for measuring these parameters.

For manufacturing plant these criteria may be advantageously employed in at least two ways: (i) to provide a speed increase thereby more effectively utilizing existing plant, or (ii) for a given coating speed to enable a voltage decrease thereby reducing the adverse effects of high voltages exemplified in European Patent No. 1,013,586 and U.S. Pat. No. 5,609,923.

Various webs can be employed in the application of the present invention and include, but are not limited to, paper, plastic films, resin-coated paper and synthetic paper. Plastic films may be made of polyolefins such as polyethylene and polypropylene, vinyl polymers such as polyvinyl acetate, polyvinyl chloride and polystyrene, polyamides such as 6, 6-nylon and 6-nylon, polyesters such as polyethylene terephthalate and polyethylene-2, 6-naphthalate, polycarbonates and cellulose acetates such as cellulose monoacetate, cellulose diacetate and cellulose triacetate. Resins used to make resin-coated paper are exemplified by but not limited to polyolefins such as polyethylene. Additionally, the webs may have subbing layers containing surfactants for the purpose of enhancing wetting, adhesion or other purposes. The web may also contain electrically conductive layers. The web used should have a surface roughness, Rz, of at least 2 μm, but preferably not more than about 20 μm. Examples of such webs are those used in the manufacture of photographic papers which have a glossy surface, matte surface or lustre surface, etc. These webs are commonly manufactured from raw paper stock onto which is laminated one or more polyethylene layers which may be compressed with an embossed roller to obtain a desired surface roughness. Alternatively, webs with such roughness may be obtained by using solid particles or the like dispersed and coated within the subbing or other layers of a photographic film support or by embossing or finely abrading the aforesaid plastic film types, or by any other method that leads to a surface topography having the appropriate roughness. The layers of coating material can include photographic emulsions, protective layers, filter layers, or the like.

Figure 2:
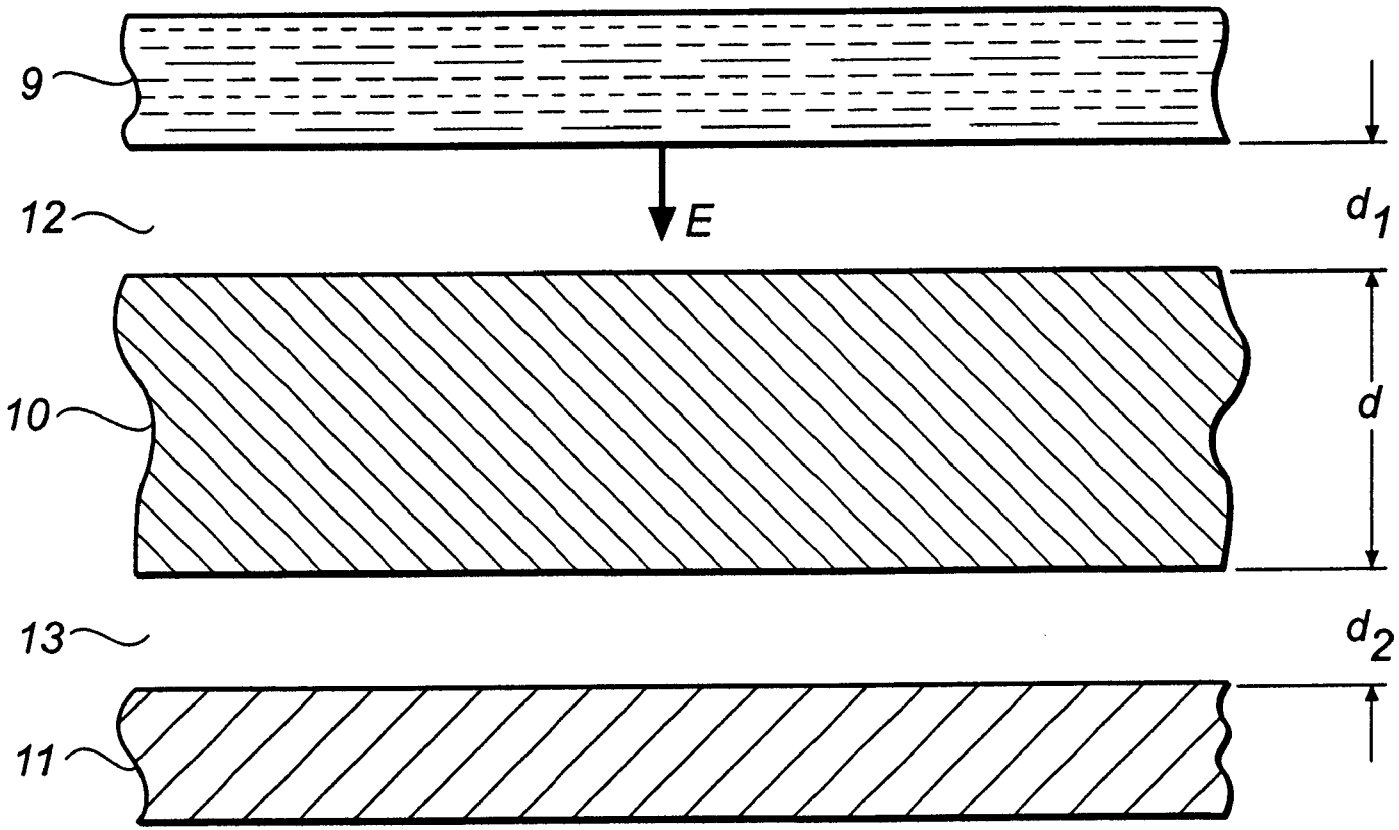
FIG. 2 shows a schematic representation of a web being coated used in demonstrating how to calculate the electrostatic field strength for use in the method of the present invention; and, FIG. 3 is a graph showing the coating speed, as a function of voltage applied to the coating roller, for three webs of differing roughness.

One preferred method for generating the required electrostatic field, involves the application of a voltage between the coating roller and the coating liquid. The field strength is calculated using standard methods of electrostatics from an equivalent capacitor arrangement as shown in FIG. 2. With reference to FIG. 2, a coating liquid 9, which should be regarded as a conductor, is coated onto a web 10. The web 10 may be a composite layer comprising semi-conductive or partially conductive layers with charges at various locations within its body and at its surfaces. A supporting structure 11, such as a coating roller, may be set at a different potential to that of the liquid 9. Air gaps 12 and 13 may or may not be present depending on the situation. The field strength (shown schematically as E) at the receiving surface of web 10 is dependent upon the distribution of charges and potentials and the relative potentials of the coating liquid 9 and structure 11. However, for a given structure and charge distribution, the field strength can be readily computed (see, for example, standard electrostatics textbooks, e.g. P. Lorain, D. R. Corson "Electro-magetism" pub. Freeman 1979 or "Electrets" ed. G. M. Sessler pub. Springer-Verlag 2nd edition 1987). To generate the electrostatic field, a voltage can be applied to an ungrounded, conductive coating roller while maintaining the coating composition at ground potential or by applying charges to the receiving surface of the web. Typically, field strengths in the range 3 to 30 kV/mm are required to provide the necessary stabilising effect.

The following working examples are provided to further describe practical embodiments of the invention:

EXAMPLE 1

Figure 3:
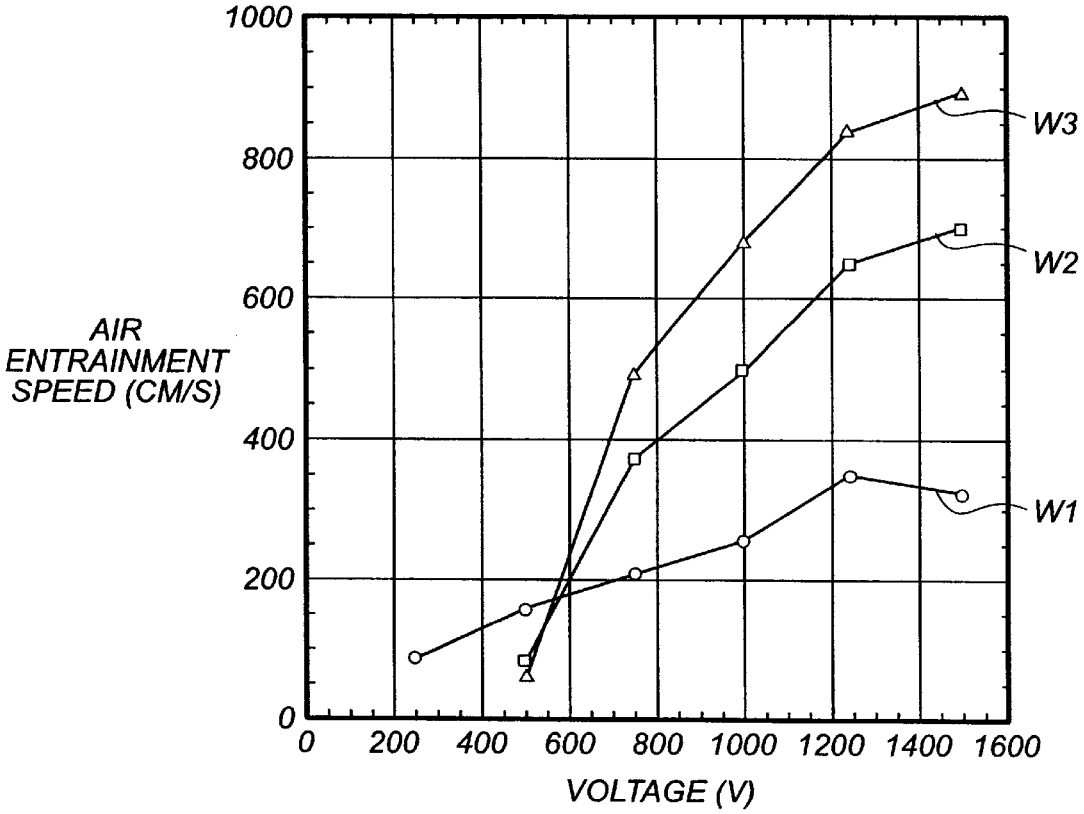

The advantages of the apparatus and method of the present invention are demonstrated by the graph in FIG. 2 and summarized in table 1 below. The Figure shows three relationships (W1, W2, W3) between the voltage applied to generate an electrostatic field and the air entrainment speed for three webs of differing roughness. A bead coating arrangement was provided and a single layer of aqueous gelatin solution supplied to make the coatings. The viscosity of the gelatin solution was 100 mPas measured at a shear rate less than that for which the solution began to shear thin and about 90 mPas at a shear rate of 10,000 $s^{-1}$. The total flow rate per unit width of the coating solution was set at 2.7 $cm^2/s$. Three webs were coated at several different voltages. The smoothest web was polyethylene teraphthalate (W1 in FIG. 3) with Rz=0.6 $\mu$m, the next rougher web was paper covered with a polyethylene resin coating (W2 in FIG. 3) with Rz=4.4 $\mu$m, and the roughest web, was also paper covered with a polyethylene resin coating (W3 in FIG. 3) with Rz=9.7 $\mu$m.

TABLE 1

| | Web Air-Entrainment Speed | | |
|---|---|---|---|
| Voltage | Rz = 0.6 $\mu$m | Rz = 4.4 $\mu$m | Rz = 9.7 $\mu$m |
| 250 V | 82 cm/s | No data | No data |
| 500 V | 154 cm/s | 80 cm/s | 58 cm/s |
| 750 V | 205 cm/s | 372 cm/s | 491 cm/s |
| 1000 V | 256 cm/s | 497 cm/s | 680 cm/s |
| 1250 V | 350 cm/s | 650 cm/s | 845 cm/s |
| 1500 V | 325 cm/s | 700 cm/s | >900 cm/s |

These examples demonstrate both the limitations of the prior art (with Rz=0.6 $\mu$m) and the remarkable improvement in coating speed for the present invention. For a voltage of 500V or less, the air-entrainment speed decreases as web roughness increases as suggested by the capillary number criterion of EP 716,890 and demonstrated by the example in WO89/05477. However at 750V and above, it can be seen that the air-entrainment speed increases as the web roughness increases. Moreover, the air-entrainment speeds attained are far in excess of those attained for the smooth web.

EXAMPLE 2

A bead coating arrangement was employed to make a coating of thickness 75 $\mu$m. The coating consisted of three layers: a top layer of viscosity 40 mPas, a middle layer of viscosity 100 mPas and a bottom layer of varying viscosity and rheology. This combination was coated on a rough surface (Rz=9.7 $\mu$m) and a smooth surface (Rz=1.6 $\mu$m) and the minimum voltage required to obtain a coating at 450 cm/s without air-entrainment measured. In each case the gap between the die and the web was set at about 300 $\mu$m. The pressure in the reduced pressure chamber was set at about 150 Pa. Table 2 below summarizes the coatings. Experiments 1, 2, 3, 4, 8, 9 demonstrate the prior art wherein a high voltage is required to coat without defects and wherein a rough surface requires a higher voltage to coat at the same speed under the equivalent conditions as a smooth surface.

Experiments 6 and 7 show, when compared with experiment 5, that the voltage required to coat without defect is reduced significantly when a combination of high viscosity (measured at 10,000 $s^{-1}$), a rough support and electrostatic voltage is employed.

TABLE 2

| Exp. # | Viscosity ($\gamma$ = 10$s^{-1}$) | Viscosity ($\gamma$ = 10,000$s^{-1}$) | Roughness Rz | Minimum voltage for good coating |
|---|---|---|---|---|
| 1 | 3 mPas | 3 mPas | 1.6 $\mu$m | 500 |
| 2 | 13 mPas | 13 mPas | 1.6 $\mu$m | 500 |
| 3 | 3 mPas | 3 mPas | 9.7 $\mu$m | 600 |
| 4 | 13 mPas | 13 mPas | 9.7 $\mu$m | 600 |
| 5 | 45 mPas | 40 mPas | 1.6 $\mu$m | 650 |
| 6 | 45 mPas | 40 mPas | 9.7 $\mu$m | 360 |
| 7 | 75 mPas | 62 mPas | 9.7 $\mu$m | 250 |
| 8 | 20 mPas | ≈8 mPas | 9.7 $\mu$m | 600 |
| 9 | 55 mPas | ≈8 mPas | 9.7 $\mu$m | 600 |

EXAMPLE 3

A bead coating arrangement was employed to make a coating of about 60 $\mu$m thickness. The coating consisted of a single layer of aqueous gelatin. This was coated on a rough surface (Rz=9.7 $\mu$m) and a less rough surface (Rz=4.4 $\mu$m). Samples were obtained at a coating speed of 550 cm/s and an electrostatic voltage applied to the backing roller of 1000 V. The dry samples were then assessed for coating quality. The results are listed in table 3. In comparison, experiment 4 demonstrates the remarkable feature of the present invention in that the more viscose liquid when coated on a suitably rough web alleviates air-entrainment.

TABLE 3

| Exp. # | Viscosity ($\gamma$ = 10$s^{-1}$) | Roughness Rz | Air-Entrainment? |
|---|---|---|---|
| 1 | 23 mPas | 4.4 $\mu$m | Yes |
| 2 | 23 mPas | 9.7 $\mu$m | Yes |
| 3 | 144 mPas | 4.4 $\mu$m | Yes |
| 4 | 144 mPas | 9.7 $\mu$m | No |

The invention has been described in detail with particular reference to certain preferred embodiments thereof, but it will be understood that variations and modifications can be effected within the spirit and scope of the invention.

What is claimed is:

1. A method of bead coating a web using a coating die, the web and die being moveable relative to each other, the web being supported by a support, said method comprising the steps of:

forming one or more layers of coating material using the coating die;

allowing the one or more layers to impinge on the web as the web and die move relative to each other, the web surface having an average peak to peak roughness (Rz) as defined by DIN 4768, ISO4287 or BS 1134 greater than or equal to 2 $\mu$m and less than or equal to 20 $\mu$m, wherein the layer of coating material forming a wetting layer adjacent to said web has a viscosity of between 35 mPas and 200 mPas measured at a shear rate of substantially 10,000 $s^{-1}$; and providing an electrostatic field at the point at which the one or more layers impinges on the web to stabilize the one or more layers of coating material.

2. A method according to claim 1, wherein the electrostatic field strength is between 3 and 30 kV/mm.

3. A method according to claim 2, in which the support is a backing roller and the electrostatic field is provided by a voltage of between 250V and 2000V between the one or more layers and the backing roller.

4. A method according to claim 3, in which the voltage provided between the one or more layers and the backing roller is between 600V and 1500V.

5. A method according to claim 2, wherein the viscosity of the coating material forming the wetting layer has a viscosity measured at a shear rate of 10,000 $s^{-1}$ of between 50 mPas and 100 mPas.

6. A method according to claim 2, wherein the web is made of a material selected from the group consisting of paper, plastic films, resin-coated paper, synthetic paper, plastic films overcoated with a subbing layer containing surfactant.

7. A method according to claim 2, wherein said one or more layers of coating material comprise photographic emulsions, protective layers, or filter layers.

8. A method according to claim 1, in which the support is a backing roller and the electrostatic field is provided by a voltage of between 250V and 2000V between the one or more layers and the backing roller.

9. A method according to claim 8, in which the voltage provided between the one or more layers and the backing roller is between 600V and 1500V.

10. A method according to claim 1, wherein the roughness Rz is greater than 4 $\mu$m and less than 10 $\mu$m.

11. A method according to claim 1, wherein the viscosity of the coating material forming the wetting layer has a viscosity measured at a shear rate of 10,000 $s^{-1}$ of between 50 mPas and 100 mPas.

12. A method according to claim 1, wherein the electrostatic field is generated by charges on the web.

13. A method according to claim 1, wherein the web is made of a material selected from the group consisting of paper, plastic films, resin-coated paper, synthetic paper, plastic films overcoated with a subbing layer containing surfactant.

14. A method according to claim 1, wherein said one or more layers of coating material comprise photographic emulsions, protective layers, or filter layers.

15. A method according to claim 1, wherein the web is formed by a web of material, the web being arranged to move continuously relative to the coating die and being positioned at a predetermined separation from the die to enable formation of a bead of coating material between the material and the die.

* * * * *